US007941961B1

(12) United States Patent
Cooper

(10) Patent No.: US 7,941,961 B1
(45) Date of Patent: May 17, 2011

(54) SYSTEM FOR RECEIVING SPENT CARTRIDGE CASES FROM A FIREARM

(76) Inventor: LaDrew V. Cooper, Riddle, OR (US)

( * ) Notice: Subject to any disclaimer, the term of this patent is extended or adjusted under 35 U.S.C. 154(b) by 163 days.

(21) Appl. No.: 12/483,000

(22) Filed: Jun. 11, 2009

(51) Int. Cl.
*F41A 9/60* (2006.01)

(52) U.S. Cl. ..... 42/98

(58) Field of Classification Search ..... 42/1.01, 42/1.03, 98; 89/33.4
See application file for complete search history.

(56) References Cited

U.S. PATENT DOCUMENTS

| | | | | |
|---|---|---|---|---|
| 5,285,593 | A * | 2/1994 | Bammate | 42/98 |
| 5,398,439 | A * | 3/1995 | Harless | 42/98 |
| 6,173,520 | B1 * | 1/2001 | Bucciarelli et al. | 42/98 |
| 6,530,169 | B1 * | 3/2003 | Griffin | 42/98 |
| 6,836,991 | B1 * | 1/2005 | Saur | 42/98 |
| 7,043,863 | B2 * | 5/2006 | Saur | 42/98 |
| 7,168,200 | B2 * | 1/2007 | Perez et al. | 42/98 |
| 7,536,821 | B1 * | 5/2009 | Saur | 42/98 |
| 2002/0007581 | A1 * | 1/2002 | Bucciarelli et al. | 42/98 |
| 2009/0100734 | A1 * | 4/2009 | Swan et al. | 42/71.01 |

* cited by examiner

*Primary Examiner* — Bret Hayes
*Assistant Examiner* — Joshua Freeman
(74) *Attorney, Agent, or Firm* — Jerry Haynes Law

(57) ABSTRACT

A cartridge catching system designed to attach to picatinny rail of a firearm to receive spent cartridge cases from the ejection port of firearm is provided. The cartridge catching system has a container body which is downwardly angled to deflect the spent cartridge cases towards the bottom of the container body. A connecting rod where one end of the connecting rod is fixed on picatinny rail of the firearm and other end is placed within an elongated hole is provided on a rod receiving assembly. The rod receiving assembly is mountable on top or within the container body to optimize the position of the container body depending on the type and size of firearm. A spring actuated ball is provided inside the elongated hole on the rod receiving assembly to fit onto the semicircular hole of the connecting rode to provide an easy ON/OFF mechanism for attaching/removing the cartridge catching system making it easy to empty the container body.

20 Claims, 8 Drawing Sheets

SYSTEM FOR RECEIVING SPENT CARTRIDGE CASES FROM A FIREARM

FIELD OF THE INVENTION

This invention relates to a cartridge catching system. More particularly, it relates to a cartridge catching system designed to attach to a picatinny rail equipped firearm to receive the spent cartridge cases from the ejection port of the firearm.

BACKGROUND OF THE INVENTION

Various semiautomatic and automatic firearms eject the spent cartridge cases after firing. These spent cartridge cases are scattered on the ground and sometimes even lost, or damaged as they land on the ground. Because cartridge cases can be reused, it is desirable to collect all spent cartridge cases. The task to collect all the empty cartridges is a challenge to an individual, especially when the shooter does not have the fixed position of firing. Also, the cartridges are ejected at high speed can strike and injure a nearby person, posing a hazard. Thus, there is a need to design a secure and safe system to automatically collect the spent cartridge cases, after the firing.

Several cartridge catching systems are available in the existing prior art, but they suffer from one or more deficiencies which limit their effectiveness. Some systems comprise a catch means, such as bags, sacks, or netting mounted to a frame and supported on the ground, placed in the direction of the cartridge ejection. Such systems lack flexibility, however, and require the shooter to be near the frame which limits the free movement of the shooter. Various other cartridge catching systems are affixed to the firearm, but they interfere with the vision of the shooter and interfere with the operation of the firearm. Many systems are shaped such as to enable the ejected cartridge to rebound towards the ejection chamber, thus posing a danger to the shooter. Another drawback with the existing prior art systems, is that they are difficult to remove or attach to the firearms. Another drawback with the existing prior art systems is that the use of a bag or sack that can swing or move, hampers the ability of the shooter to aim the firearm.

Thus, there is a need of a cartridge catching system that is easily attachable to the firearm in a manner that it does not interfere with the sight of the shooter or the operation of the firearm. In the light of the foregoing discussion, there is need of a cartridge catching system that can be easily operated to collect/remove spent cartridge cases from the firearm.

SUMMARY OF THE INVENTION

Accordingly, it is a prime objective of the present invention to overcome the above mentioned disadvantages of the prior art by providing a cartridge catching system to receive all spent cartridge cases from the ejection port of the firearm.

Another objective of the present invention is to provide a cartridge catching system that deflects the spent cartridge cases towards the bottom of the container body.

Another objective of the present invention is to provide a cartridge catching system that prevents the received cartridge cases to rebound.

Further objective of the present invention is to provide a cartridge catching system that is designed to attach to the picatinny rail of the firearm to also allow the placement of additional accessories.

Another objective of the present invention is to provide a cartridge catching system that suppresses the rattling sound of the spent cartridge cases when the cartridge cases are received.

Yet another objective of the present invention is to provide a cartridge catching system that doesn't intervene with operation of firearm and the vision of the shooter.

A further objective of the present invention is to provide a cartridge catching system that is easy to attach/remove from firearm.

Embodiments of the present invention provide a cartridge catching system that is designed to attach to the picatinny rail of the firearm by means of a connecting rod to receive spent cartridge cases from the ejection port of the firearm. The cartridge catching system has a rectangular opening faced container body which is downwardly angled to deflect the received spent cartridge cases. The connecting rod is fixed on picatinny rail firearm at one end and the other end is placed within an elongated hole provided on a rod receiving assembly. The rod receiving assembly is mountable on top or within the container body to adjust the position of the cartridge catching system. A spring actuated ball is provided inside the elongated hole on the rod receiving assembly. The ball is fitted onto the semicircular hole present on a flat portion of the connecting rod to optimize the position of the container body with reference to picatinny rail of the firearm depending on the type and size of the firearm. The spring actuated ball enables the easy ON/OFF mechanism of the cartridge catching system for emptying the container body.

BRIEF DESCRIPTION OF THE DRAWINGS

The disclosure will now be made, by way of example, with reference to the accompanying drawings, in which.

DETAILED DESCRIPTION OF THE INVENTION

Embodiments of the present invention provide a cartridge catching system to receive the spent cartridge cases from the ejection port of firearm. The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Furthermore, there is no intention to be bound by any expressed or implied theory presented in the preceding technical field, background, brief summary or the following detailed description.

Embodiments of the present invention provide a cartridge catching system designed to attach to the picatinny rail on top of a firearm to receive spent cartridge cases from the ejection port of a firearm. The cartridge catching system has a container body to collect the spent cartridge cases towards the bottom of the container body and provides an easy ON/OFF mechanism for emptying the container body. A connecting rod connects the container body with the picatinny rail on top of a firearm. One end of the connecting rod is fixed on picatinny rail on top of the firearm and other end is placed within an elongated hole provided on a rod receiving assembly. The rod receiving assembly is mountable on top or within the container body to adjust the position of the cartridge catching system with reference to ejection port of firearm. A spring actuated ball is provided inside the elongated hole on the rod receiving assembly to fit onto the semicircular hole present on flat portion of the connecting rod to optimize the position of the container body with reference to the picatinny rail of the firearm.

Figure 1:
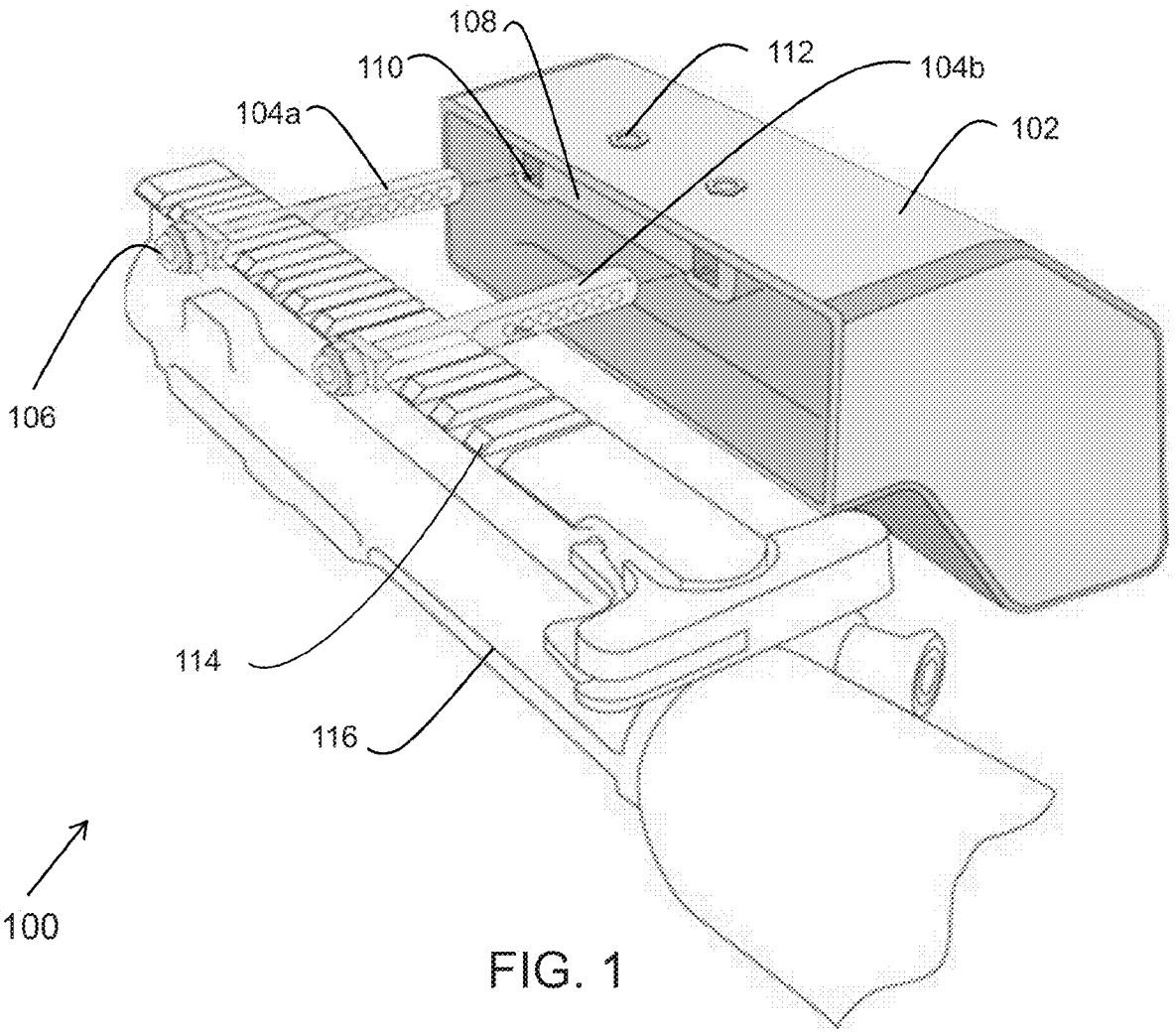
FIG. 1 is a perspective view of the cartridge catching system attached to the picatinny rail of the firearm with the rod receiving assembly, in accordance with an embodiment of the present invention.

Referring now to FIG. 1, I present a perspective view of cartridge catching system 100 attached to the picatinny rail of the firearm with the rod receiving assembly, in accordance with an embodiment of the present invention. Cartridge catching system 100 is a system to receive spent cartridge cases after the firearm has been fired. Cartridge catching system 100 includes a container body 102, connecting rods 104, nuts 106, rod receiving assembly 108, elongated hole 110, mounting screws 112, and picatinny rail 114 mounted on firearm 116.

Container body 102 is a receptacle that receives and collects the spent cartridge cases from the ejection port of a firearm. Container body 102 is distinctly shaped to deflect the spent cartridge cases towards the bottom of the container. Container body 102 is generally composed of a substantially rigid material. Examples of materials include, but are not limited to, rigid plastic, fibre-reinforced plastic, loaded (e.g., filled with a dense material such as lead, clay, or the like) plastic and the like, steel, aluminium. The preferred material for manufacturing is plastic.

Container body 102 is defined by a rectangular opening face and the walls. The opening face receives the spent cartridge cases and the walls define the capacity as well as the structure of container body 102. Details corresponding to container body 102 have been provided in conjunction with FIG. 2.

Connecting rod 104 is a solid metal rod that serves to connect container body 102 to picatinny rail 112 of firearm 114. In an embodiment of the present invention, cartridge catching system 100 includes two connecting rods 104*a* and 104*b*. Connecting rod 104 is composed of metal. Examples of metal include but are not limited to steel, aluminum, copper, and cartridge. Connecting rod 104 is of any shape along its length. Details corresponding to connecting rod 104 have been provided in conjunction with FIG. 7A and FIG. 7B.

One end of connecting rod 104 is fixed on the picatinny rail 114 by means of nuts 106. Nuts 106 securely hold the connecting rod on picatinny rail of the firearm. Picatinny rail 114 is a structure that provides a standardized mounting platform for automatic and semi-automatic firearm 116.

Rod receiving assembly 108 is a structure that connects connecting rod 104 to container body 102. Elongated holes 110 receive the connecting rod to attach the container body to the picatinny rail of the firearm. Details corresponding to rod receiving assembly 108 have been provided in conjunction with FIG. 5A and FIG. 5B.

Figure 2:
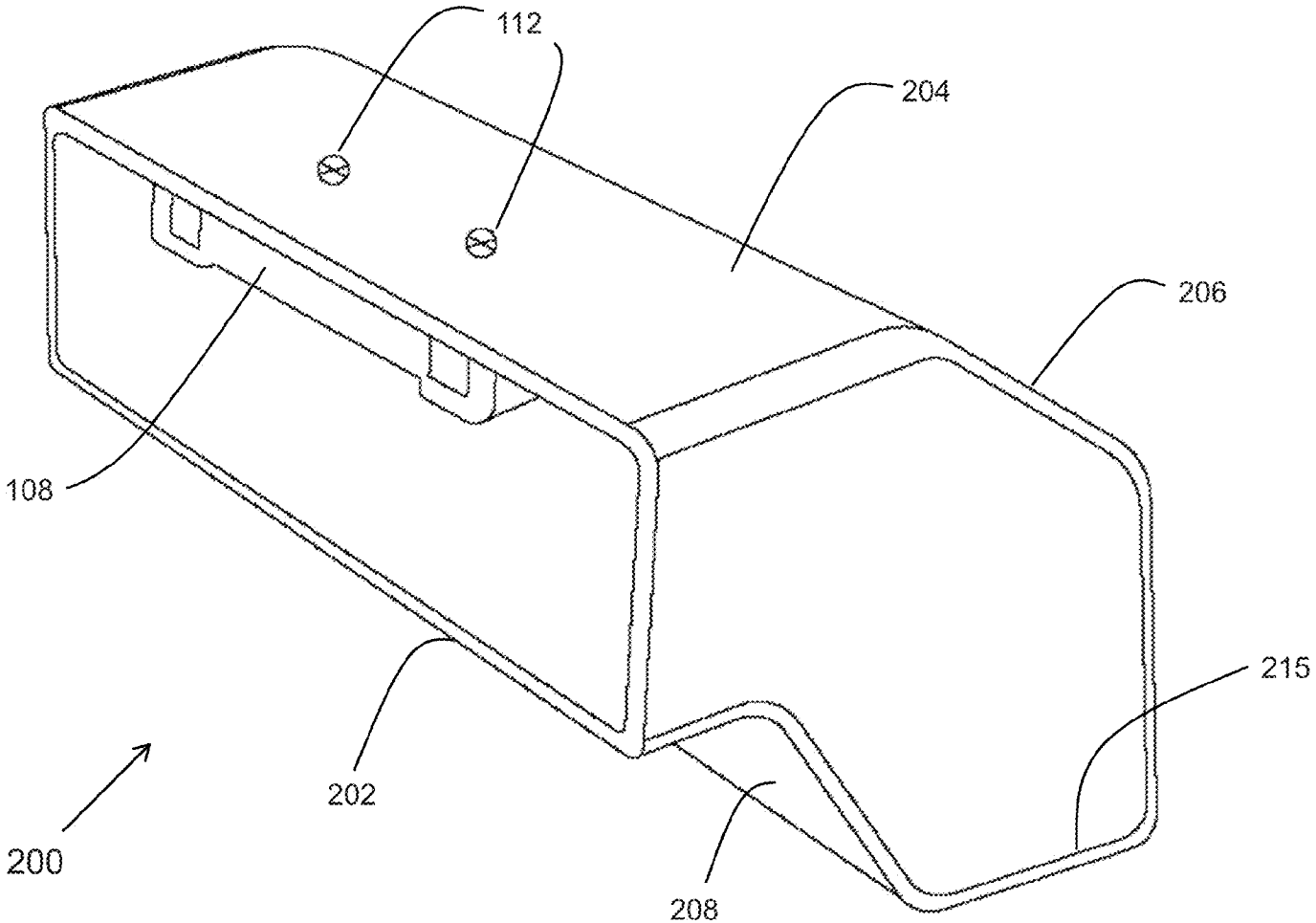
FIG. 2 is a perspective view of the container body with the rod receiving assembly placed within the container body, in accordance with an embodiment of the present invention.

FIG. 2 is a perspective view of the container body 200 with the rod receiving assembly placed within the container body, in accordance with an embodiment of the present invention.

Container body 200 is a receptacle that receives and collects the spent cartridge cases from the ejection port of a firearm. Container body 200 is distinctly shaped to deflect the spent cartridge cases towards the bottom of the container. Container body 200 is composed of a substantially rigid material. Examples of materials include, but are not limited to, rigid plastic, fibre-reinforced plastic, loaded (e.g., filled with a dense material such as lead, clay, or the like) plastic and the like. Container body 200 includes an opening face 202, surface wall 204, upper slanting wall 206, lower slanting wall 208, and bottom 215. Opening face 202 communicates with the ejection port of the firearm and receives spent cartridge cases as the cartridge are ejected from the firearm. In an embodiment of the present invention, opening face has a rectangular shape. Examples of shapes include, but are not restricted to a square, rectangle, hexagon or any polygon. In an embodiment of the present invention, container body includes a layer of acoustic foam along its inner length to suppress the rattling sound of the spent cartridge cases.

Surface wall 204 is top portion wall of container body to receive the rod receiving assembly. Upper slanting wall 206 and lower slanting wall 208 are downwardly angled walls to deflect the spent cartridge cases towards the bottom 215 of the container body away from the opening face. The angle of the slanting walls varies from 90° to 180° to deflect the spent cartridge cases. This removes the hazards that can be caused by the spent cartridge cases. The walls of the container body enclose a hollow where the spent cartridge cases are collected. Mounting screws 112 are screws for fastening the rod receiving assembly on surface wall 204 of container body.

Figure 3:
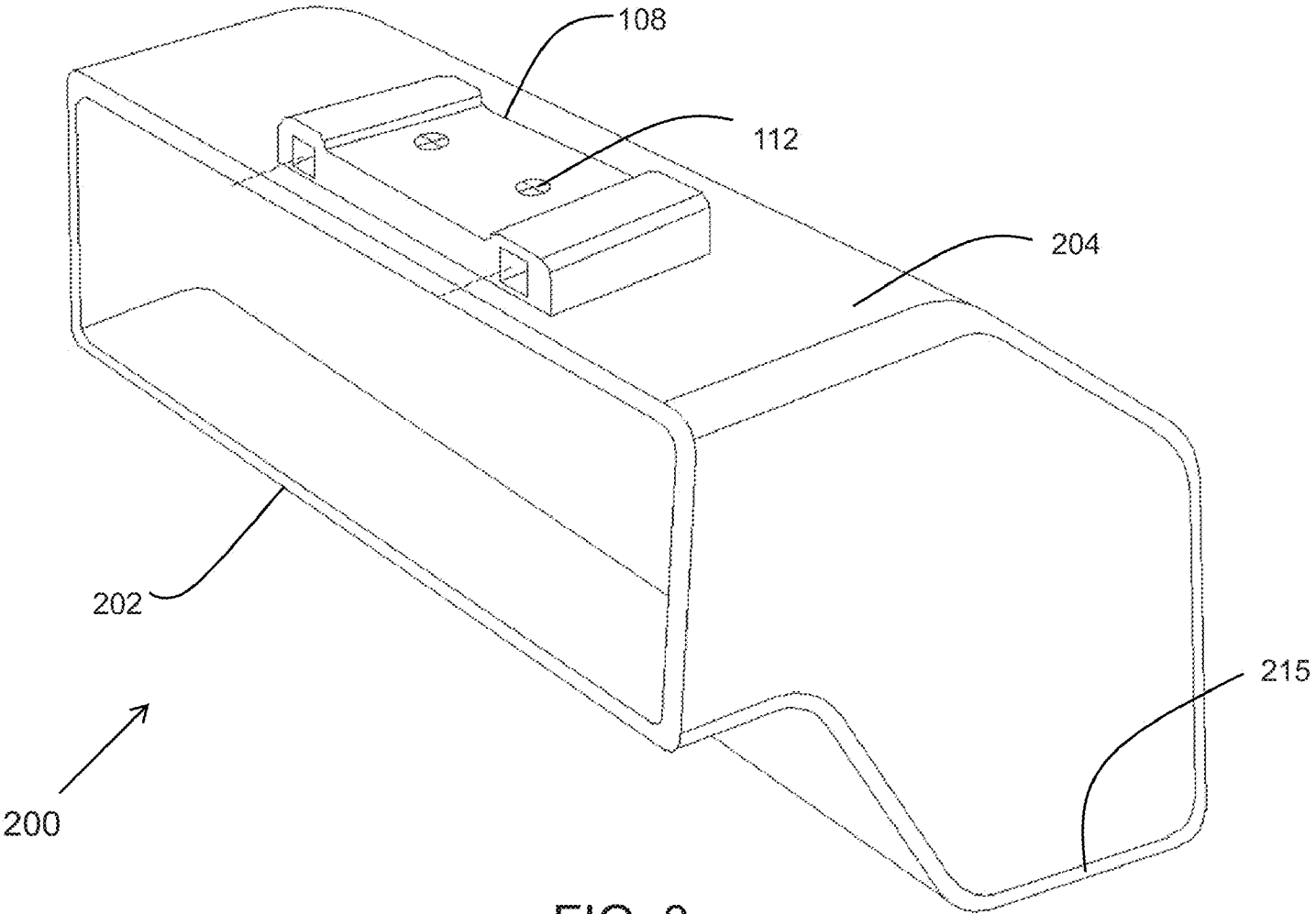
FIG. 3 is a perspective view of the container body with the rod receiving assembly placed on top of the container body, in accordance with an embodiment of the present invention.

FIG. 3 is a perspective view of the container body 200 with the rod receiving assembly placed on top of the container body, in accordance with an embodiment of the present invention. The rod receiving assembly is fastened on surface wall 204 of the container body by means of mounting screws 112. The rod receiving assembly can be positioned within or on top of the container body allowing the shooter to adjust the cartridge catching system with reference to the picatinny rail, depending on the type and size of the firearm.

Figure 4:
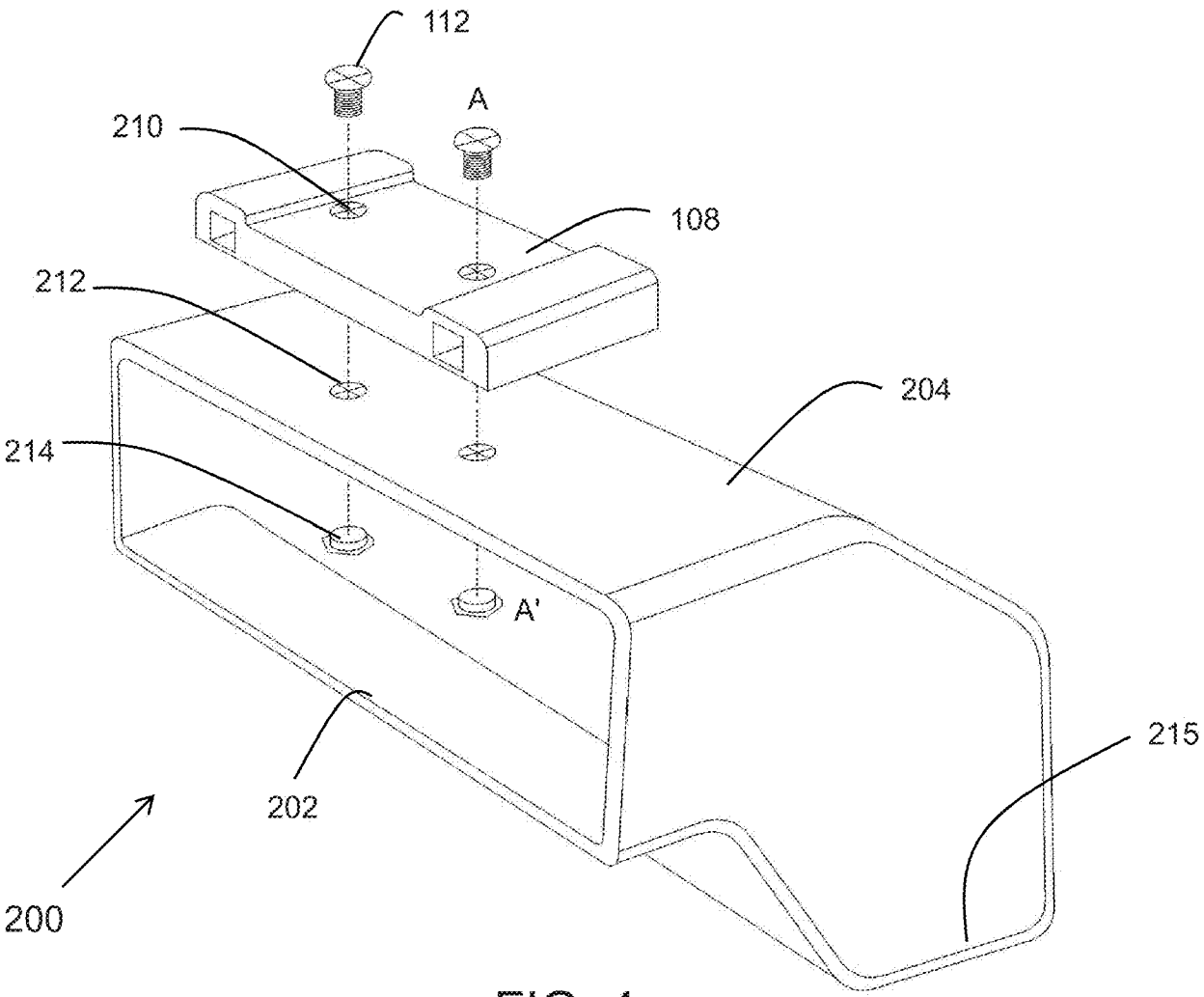
FIG. 4 is an illustrative view of the container body with the rod receiving assembly placed on top of the container body illustrating the manner of fastening of rod receiving assembly with the container body, in accordance with an embodiment of the present invention.

FIG. 4 is an illustrative view of container body 200 with the rod receiving assembly placed on top of the container body illustrating the manner of fastening of rod receiving assembly with the container body, in accordance with an embodiment of the present invention. Slots 210 and slots 212 are provided in the rod receiving assembly and the container body respectively to enable the fastening of the screws. Mounting screws 112 are aligned to fit in slots 210 of the rod receiving assembly and slots 212 of the container body to securely hold the rod receiving assembly on top of the container body. Alignment axis A-A' depicts the alignment of nuts 214, mounting screws 112, slots 210 of rod receiving assembly and slots 212 of the container body to securely tighten the rod receiving assembly on container body.

Figure 5A:
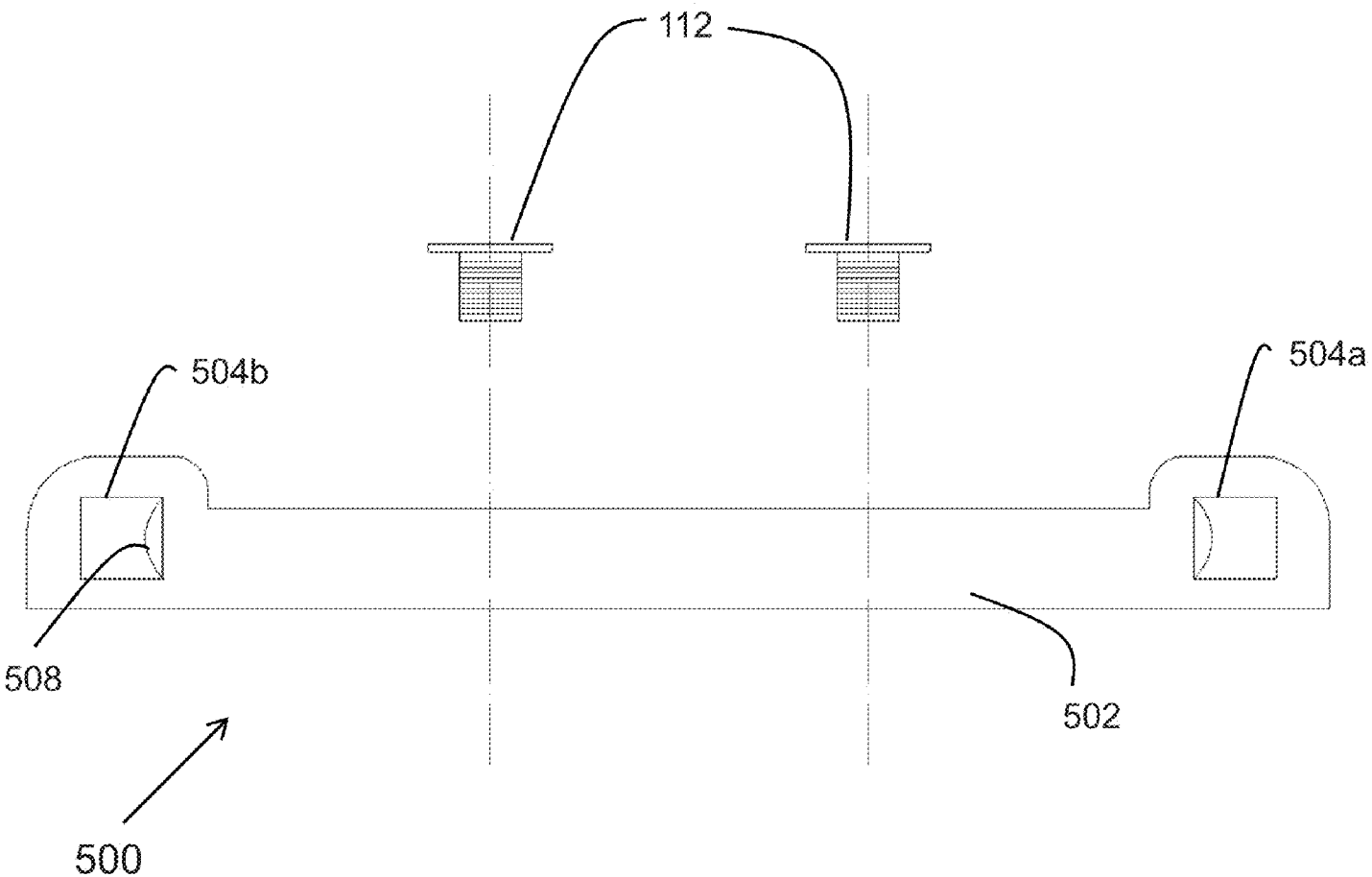
FIG. 5A is a front view of the rod receiving assembly of the cartridge catching system, in accordance with an embodiment of the present invention.
Figure 5B:
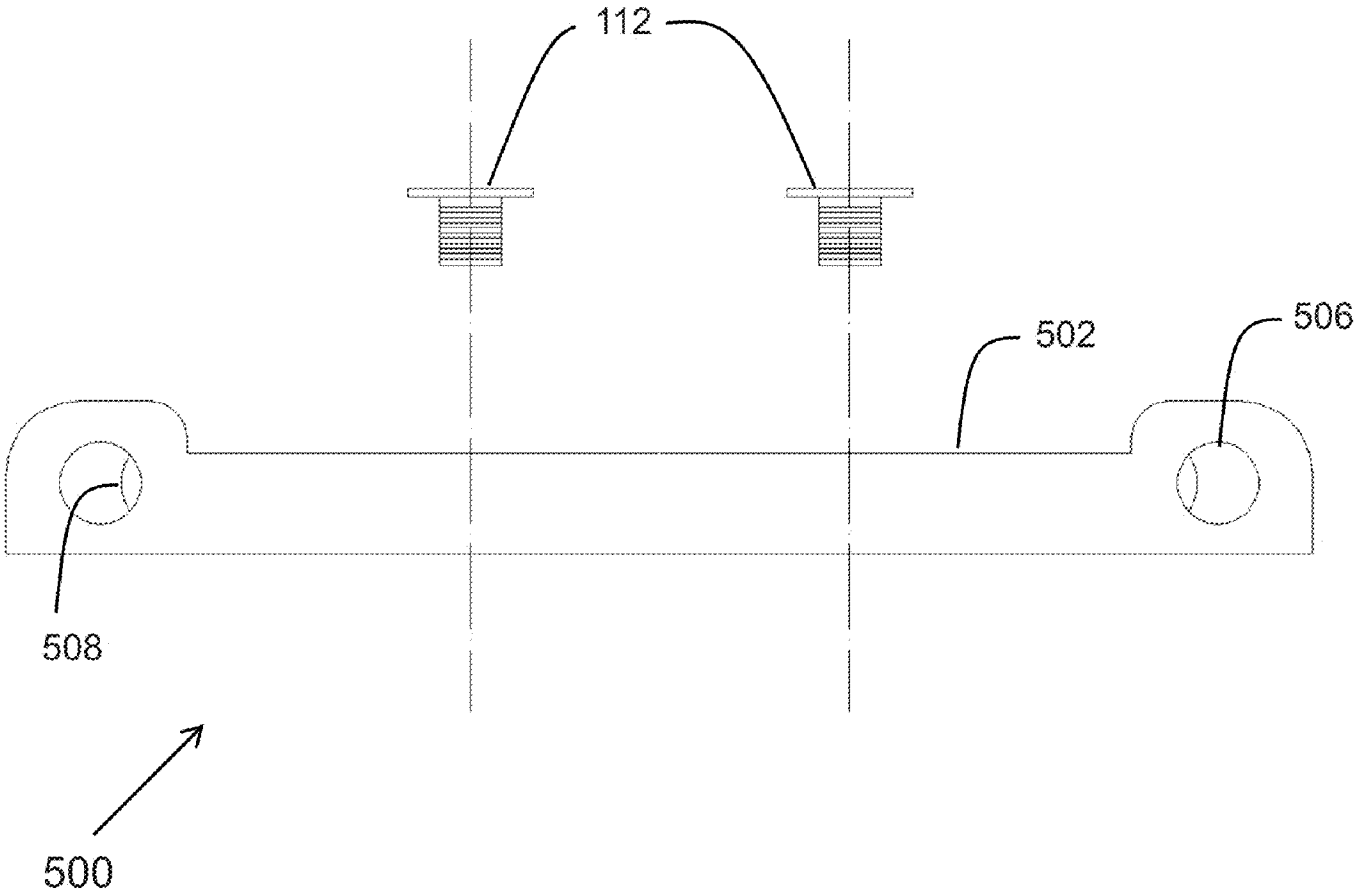
FIG. 5B is a front view the rod receiving assembly of the cartridge catching system, in accordance with another embodiment of the present invention.

Referring now to FIG. 5A and FIG. 5B, I present a front view of the rod receiving assembly 500 of the cartridge catching system, in accordance with an embodiment of the present invention. Rod receiving assembly 500 is a structure that connects connecting rod 104 to container body 102. Rod receiving assembly 500 includes mounting support 502 and elongated holes 504. The mounting support forms the body of the rod receiving assembly and attaches the rod receiving assembly to the container body by means of mounting screws 112. Elongated holes receive the connecting rod to attach the container body to the picatinny rail of the firearm. In an embodiment of the present invention, rod receiving assembly includes two elongated holes 504*a* and 504*b*. The elongated holes extend throughout the length of the rod receiving assembly so as to receive the connecting rod completely. This enables the shooter to fix the container body close to the picatinny rail. In an embodiment of the present invention, the shape of the inside cavity of the elongated holes is similar to the outer shape of the connecting rod. In an embodiment of the present invention, the shape of the inside cavity of the elongated holes 504 is square in shape. In another embodiment of the present invention, the shape of the inside cavity of the elongated holes 506 is circular in shape. Ball cap 508 of spring ball detent is provided within the rod receiving assembly to lock the connecting rod.

Figure 6:
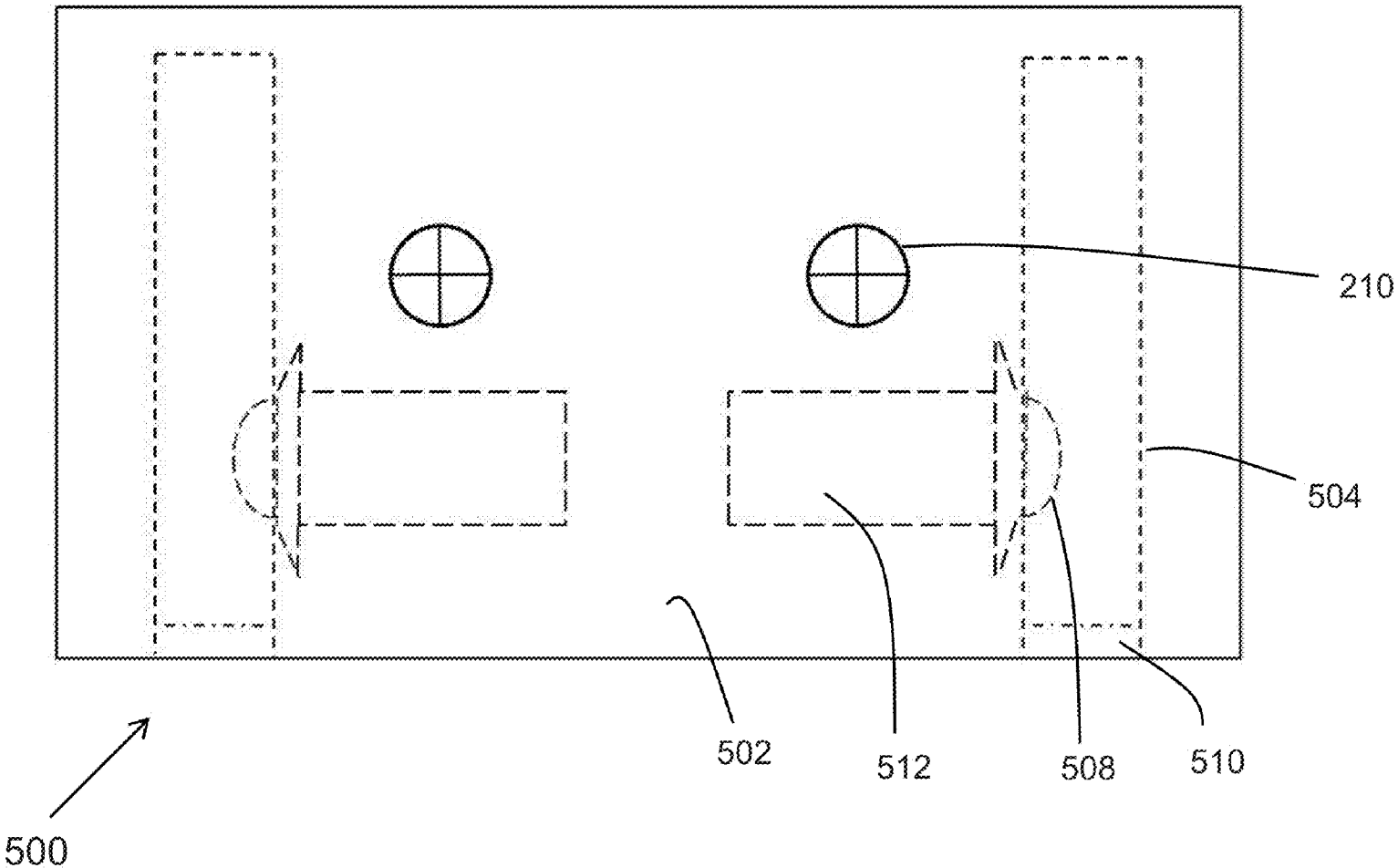
FIG. 6 is a top view of the rod receiving assembly of the cartridge catching system, in accordance with an embodiment of the present invention.

FIG. 6 is a top view of the rod receiving assembly 500 of the cartridge catching system, in accordance with an embodiment of the present invention. Rod receiving assembly 500 includes a mounting support 502, elongated holes 504, opening end of elongated holes 510, slots 210, and spring ball detent 512.

The mounting support has slots 210 for receiving screws. Screws are fastened on mounting support of the rod receiving assembly to securely hold the rod receiving assembly to the container body. In an embodiment of the present invention, the rod receiving assembly is fastened on the top of the container assembly. In another embodiment of the present invention, the rod receiving assembly is fastened within the container assembly. The rod receiving assembly can be positioned within or on top of the container body allowing the shooter to adjust the cartridge catching system with reference to the picatinny rail, depending on the type and size of the firearm. The elongated holes receive the connecting rod to attach the cartridge catching system to the picatinny rail of the firearm.

Spring ball detent 512 is a simple mechanical arrangement used to hold a moving part in a temporarily fixed position relative to another part. Spring ball detent 512 is located within the mounting support at the opening end 510 of the elongated holes. The ball cap 508 of the spring ball detent 512 fits into one of the semicircular holes of the connecting rod to lock the position of container body. This enables easy ON/OFF mechanism of the cartridge catching system and thus, easy attachment or removal of the cartridge catching system. The easy locking mechanism also helps in adjusting the distance of the container body with reference to the picatinny rail of the firearm. In an embodiment of the present invention, the ball cap 508 is a single, metal sphere, sliding within a bored cylinder, against the pressure of a spring, which pushes the ball cap 508 against the other part of the mechanism, which carries the detent.

Figure 7A:
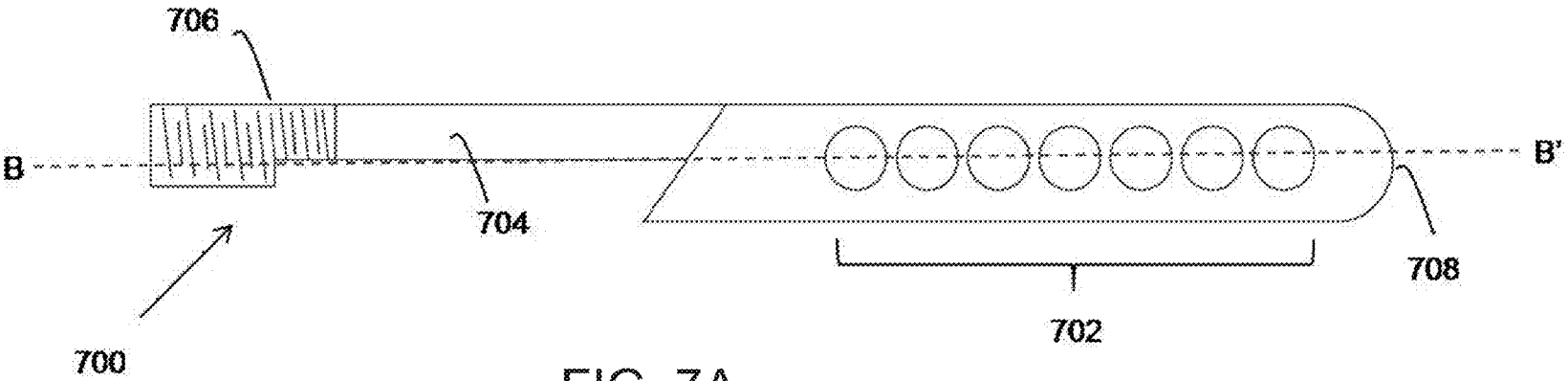
FIG. 7A is a top view of the connecting rod of the cartridge catching system, in accordance with an embodiment of the present invention.

FIG. 7A is a cross-sectional top view of the connecting rod 700 of the cartridge catching system, in accordance with an embodiment of the present invention. Connecting rod 700 includes a row of equidistant semi-circular holes 702, stem 704 and external thread 706. Connecting rod 700 is a solid metal rod that serves to connect container body 102 to picatinny rail 114 of firearm 116. Connecting rod 700 is composed of metal. Examples of metal include but are not limited to steel, aluminum, copper, and brass. Connecting rod 700 is of any outer shape along its length. In an embodiment of the present invention, the connecting rod is square in outer shape along its length. In another embodiment of the present invention, the connecting rod is circular in outer shape along its length.

Connecting rod 700 bears a row of symmetrically placed equidistant semi-circular holes 702 on the opposite faces. The semicircular holes enable the connecting rod to lock with the container body through ball cap 508 of spring ball detent 512 within the rod receiving assembly. The ball cap of the spring ball detent fits into one of the semicircular holes to lock the container body. In an embodiment of the present invention, the ball cap fits into one of the semi-circular holes of the connecting rod and locks it in. The locked semicircular hole is in line with the ball cap of the spring ball detent and falls partially into the semicircular hole under spring pressure, holding the connecting rod at that position. Additional force is applied to the connecting rod to push the ball cap back into its cylinder, compressing the spring, and allowing the connecting rod to move inside/outside the elongated holes. This enables easy attachment or removal of the cartridge catching system and helps in adjusting the distance of the container body with reference to the picatinny rail of the firearm.

Stem 704 forms the body of the connecting rod to be fixed on picatinny rail of the firearm. One end of connecting rod 700 is provided with external thread 706 for nuts 106 to fasten. Nuts 106 fasten to securely hold the connecting rod to picatinny rail of the firearm. Other end 708 of connecting rod 700 is enabled to enter the elongated holes of the rod receiving assembly to attach the cartridge catching system with the firearm.

Figure 7B:
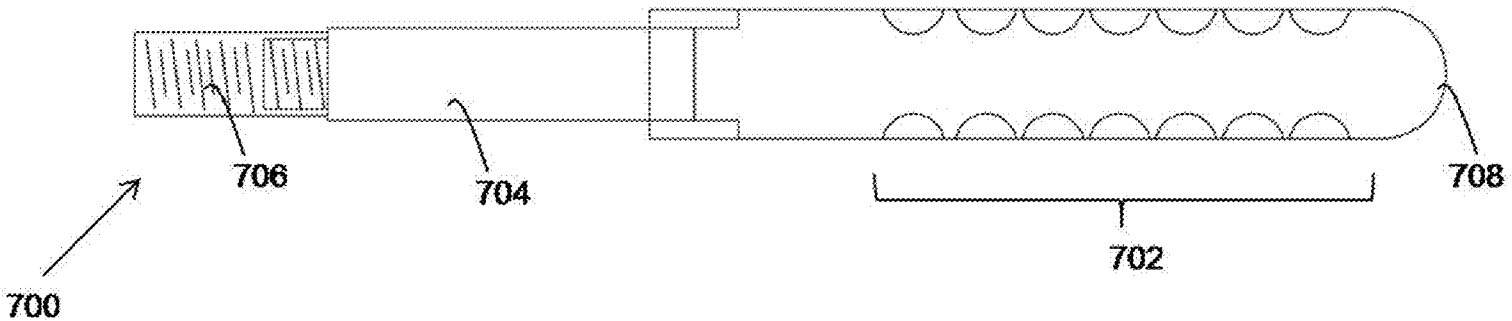
FIG. 7B is a cross-sectional view of the connecting rod of the cartridge catching system taken along line B-B of FIG. 7A, in accordance with an embodiment of the present invention.

FIG. 7B is a side view of the connecting rod 700 of the cartridge catching system, in accordance with an embodiment of the present invention. Connecting rod 700 includes a row of semi-circular holes 702, stem 704 and external thread 706.

In another embodiment of the present invention, the rod receiving assembly is integrated within the container body. Container body is provided with elongated holes to receive the connecting rod to attach the cartridge catching system to the firearm.

The brass catching system of the present invention fulfill the objects set forth at the beginning of the description and provide a system to receive spent cartridge cases towards the bottom of the container body and has an easy ON/OFF mechanism for emptying the container box this is given by inventor to attach/remove the system.

While the illustrative embodiments of the disclosure have been described above, it will be recognized and understood that various modifications can be made in the disclosure and the appended claims are intended to cover all such modifications which may fall within the spirit and scope of the disclosure.

I claim:

1. A cartridge catching system designed to attach to a picatinny rail equipped firearm to receive spent cartridge cases from an ejection port of the firearm comprising:

a container body wherein the container body comprises an open face with extended walls wherein each wall is downwardly angled back to deflect the spent cartridge cases towards the bottom of the container body;

a rod receiving assembly mounted on the container body to attach the container body by way of a connecting rod, the rod receiving assembly further comprises:

at least one elongated hole to receive the connecting rod;

a spring actuated ball within the elongated hole to provide a locking mechanism; and at least one hole for fastening the rod receiving assembly to the container body;

at least one connecting rod, having a first end and a second end, wherein the first end of the connecting rod is fixed on the picatinny rail of the firearm and second end is placed within the elongated hole provided on the rod receiving assembly mounted on the container body; and at least one semi circular hollow hole on a flat body portion of the connecting rod to fit on to the spring actuated ball to adjust the container body with the picatinny rail of the firearm.

2. The system of claim 1, wherein the container body is manufactured using a fibrous material.

3. The system of claim 1, wherein the open face of the container body is rectangular in shape.

4. The system of claim 1, wherein the container body further comprises a layer of acoustic foam along an inner length of the container body sufficient to suppress a rattling sound of the spent cartridge cases.

5. The system of claim 1, wherein the rod receiving assembly is positioned within the container body.

6. The system of claim 1, wherein the picatinny rail comprises a standardized mounting platform.

7. The system of claim 1, wherein the inside cavity shape of the elongated hole is similar to the outside shape of the connecting rod.

8. The system of claim 1, wherein the spring actuated ball is positioned at an open end of the elongated hole.

9. The system of claim 1, wherein the one end of the connecting rod is provided with an external thread for a nut to securely hold the connecting rod to the picatinny rail of the firearm.

10. The system of claim 1, wherein the shape of the connecting rod is selected from the group consisting of a square, circular, rectangle and triangle.

11. The system of claim 1, wherein the material used for manufacturing the connecting rod is selected from the group the group consisting of aluminum, steel and iron.

12. The system of claim 11, wherein an end of the connecting rod is provided with an external thread for nut to securely hold the connecting rod to picatinny rail of the firearm.

13. An automatic cartridge catching system designed to attach to a picatinny rail of a firearm to securely receive spent cartridge cases from an ejection port of the firearm comprising:

a container body wherein the container body has a rectangular open face with extended walls wherein each wall is downwardly angled back to deflect the spent cartridges towards the bottom of the container body;

at least one connecting rod to connect the container body to the picatinny rail of firearm;

at least one elongated hole on the container body to receive the connecting rod;

a spring actuated ball within the elongated hole to provide a locking mechanism; and at least one semicircular hollow hole on a flat body portion of the connecting rod to fit on to the spring actuated ball to adjust the position of the container body with reference to the ejection port of firearm.

14. The system of claim 12, wherein the container body is manufactured using a fibrous material.

15. The system of claim 13, wherein the container body further comprises a layer of acoustic foam along the inner length of the container body to suppress the rattling sound of the collected spent cartridge cases.

16. The system of claim 13, wherein the elongated hole on container body is enabled to position within the container body or on top of the container body.

17. The system of claim 13, wherein the picatinny rail of the firearm is a standardized mounting platform.

18. The system of claim 13, wherein the inside cavity shape of the elongated hole is similar to the outside shape of the connecting rod.

19. The system of claim 13, wherein the shape of the connecting rod is selected from square, circular, rectangle or triangle.

20. The system of claim 19, wherein the material used for manufacturing connecting rod is selected among aluminum, steel or iron.

* * * * *